US007142794B2

(12) United States Patent
Fujita et al.

(10) Patent No.: US 7,142,794 B2
(45) Date of Patent: Nov. 28, 2006

(54) IMAGE FORMING APPARATUS

(75) Inventors: Masanari Fujita, Hitachi (JP); Kazuhiro Wakamatsu, Hitachi (JP); Masahiko Saito, Hitachi (JP); Masashi Yamamoto, Hitachi (JP); Yasuo Takuma, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/037,229

(22) Filed: Jan. 19, 2005

(65) Prior Publication Data

US 2005/0169661 A1 Aug. 4, 2005

(30) Foreign Application Priority Data

Jan. 29, 2004 (JP) ..... 2004-021824

(51) Int. Cl.
*G03G 15/02* (2006.01)

(52) U.S. Cl. ..... 399/100; 399/174; 399/176

(58) Field of Classification Search ..... 399/100, 399/176, 174

See application file for complete search history.

(56) References Cited

U.S. PATENT DOCUMENTS 5,765,076 A * 6/1998 Ogata et al. ..... 399/168
5,842,081 A * 11/1998 Kaname et al. ..... 399/50
6,115,565 A * 9/2000 Noda ..... 399/102

FOREIGN PATENT DOCUMENTS

| | | |
|---|---|---|
| JP | 5-188738 | 7/1993 |
| JP | 09190051 A * | 7/1997 |
| JP | 11-288150 | 10/1999 |
| JP | 2001-175057 | 6/2001 |
| JP | 2001-201923 | 7/2001 |
| JP | 2001-350313 | 12/2001 |

* cited by examiner

*Primary Examiner*—David M. Gray
*Assistant Examiner*—Joseph S. Wong
(74) *Attorney, Agent, or Firm*—McGuireWoods LLP

(57) ABSTRACT

A metal holder has a V-shape in cross-section formed by two arm sections. PET sheets are attached to mutually opposed surfaces of respective arm sections, and part of each PET sheet extends toward the electrically-conductive roller beyond the arm section. Flocked sheets are attached to the surfaces of the respective PET sheets opposite the electrically-conductive roller, and contact the electrically-conductive roller.

16 Claims, 2 Drawing Sheets

IMAGE FORMING APPARATUS

BACKGROUND OF THE INVENTION

1. Field of the Invention

The present invention relates to an image forming apparatus provided with a cleaning device that cleans a charger.

2. Description of the Related Art

There has been known a multicolor image forming apparatus that can be applied to a color printer, color copier, color facsimile, or the like. In such an image forming apparatus, a contact charger uniformly charges a surface of a photosensitive body, and an exposure device emits a laser beam to the surface of the photosensitive body, thereby forming an electrostatic latent image thereon. A developing device develops the electrostatic latent image into a visible toner image. The toner image is then transferred onto recording paper via an intermediate transfer body, and is fixed to the recording paper by a fixing device.

In this type of multicolor image forming apparatus, it is important to uniformly charge the surface of the rotating photosensitive body. In order to uniformly charge the surface of the rotating photosensitive body, there has been proposed to use two contact chargers disposed in contact with the photosensitive body. Specifically, an upstream-side contact charger in the rotation direction of the photosensitive body charges the surface of the photosensitive body, and a downstream-side contact charger eliminates the unevenness of charging of the photosensitive body, thereby making electric potential of the surface of the photosensitive body uniform. However, with this configuration, the downstream-side contact charger becomes contaminated with toner, silica, or the like, over a long time of use. As a result, discharge from the contaminated parts of the charger may be inadequate, and unevenness of charging of the photosensitive body may occur.

To solve this problem, Japanese Patent-Application Publication No. 2001-175057, No. HEI-11-288150, No. 2001-201923, No. 2001-350313, and No. HEI-5-188738 disclose an image forming apparatus which is provided with a cleaning member that cleans off toner, silica, and the like, by bringing a sponge, brush, pad, urethane foam, felt, or the like, into contact with a contact charger.

SUMMARY OF THE INVENTION

However, when urethane foam or a sponge is used for cleaning a contact charger, toner, silica, or the like wiped from the contact charger soon clogs the foam cells of the urethane foam or the sponge. Consequently, cleaning capability of the urethane foam or the sponge cannot be maintained over a long period of time. Also, a brush or pad has poor cleaning capability and thus cannot remove thoroughly toner, silica, or the like. As a result, a contact charger is contaminated with toner, silica, or the like, and unevenness of charging of the photosensitive body will occur.

In view of the foregoing, it is an object of the present invention to provide an image forming apparatus including a cleaner that can maintain cleaning capability over a long period, and can extend the life of a contact charger.

In order to attain the above and other objects, according to one aspect of the present invention, there is provided an image forming apparatus including a photosensitive body that is rotatable in a predetermined direction, a first charger that contacts the photosensitive body and charges a surface of the photosensitive body, a second charger that contacts the photosensitive body at a position downstream from the first charger in the predetermined direction, and a cleaning device that cleans a surface of the second charger. The second charger eliminates unevenness of charging of the photosensitive body charged by the first charger, thereby making electrical potential of the photosensitive body uniform. The cleaning device has a flocked sheet that contacts the second charger at least two places.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

An embodiment of the present invention will be described with reference to FIGS. 1 and 2. In this embodiment, the present invention is applied to a full-color printer.

Figure 1:
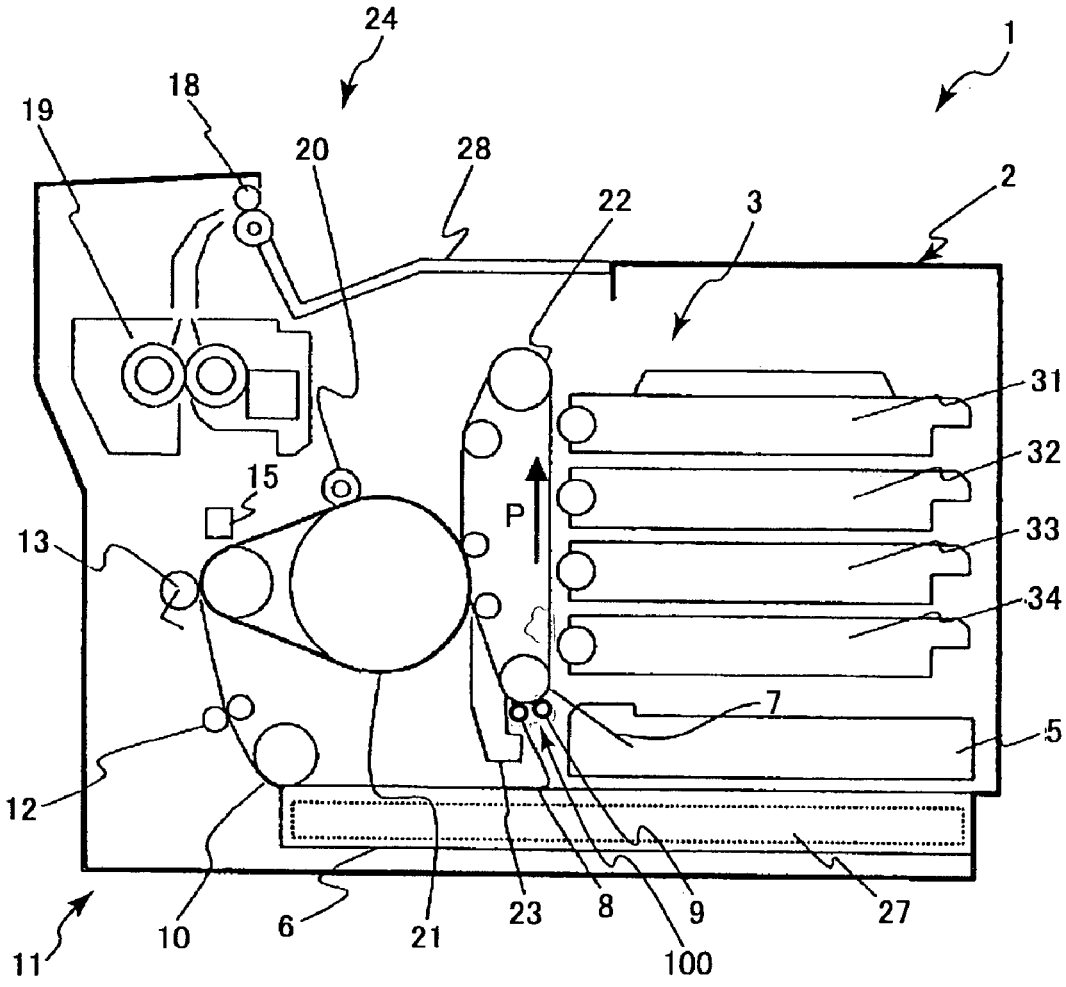
FIG. 1 is a schematic configuration diagram showing a full-color printer according to an embodiment of the present invention.
Figure 2:
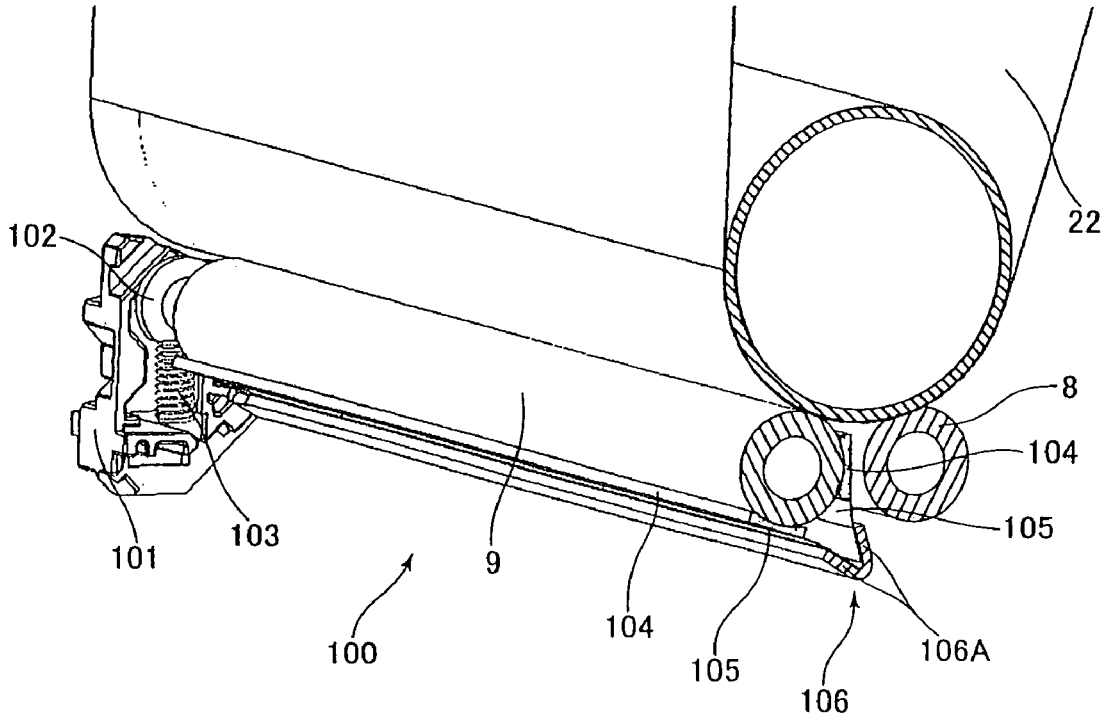
FIG. 2 is a cross-sectional perspective view of a cleaning device and its peripheral parts of the full-color printer of FIG. 1.

As shown in FIG. 1, the full-color printer 1 includes an image forming section 3, a paper feed section 11, a fixing device 19, and a paper discharge section 24, all accommodated in a main casing 2. The image forming section 3 has developing devices 31 through 34, an exposure device 5, a charging brush 8, an electrically-conductive roller 9, a photosensitive belt 22, an intermediate transfer body 21, and a transfer roller 13. The photosensitive belt 22 is driven to rotate in a direction P by a drive source (not shown). The charging brush 8 and the electrically-conductive roller 9 contact the photosensitive belt 22, and the electrically-conductive roller 9 is located on the downstream side of the charging brush 8 in the rotating direction P of the photosensitive belt 22. The charging brush 8 is for charging the photosensitive belt 22, and the electrically-conductive roller 9 is for eliminating the unevenness of charging of the photosensitive belt 22, so as to make electric potential of the surface of the photosensitive belt 22 uniform. The exposure device 5 is for forming an electrostatic latent image on the surface of the photosensitive belt 22 by emitting a laser beam 7 to the photosensitive belt 22 based on print data sent from a host device (not shown). The developing devices 31 through 34 accommodate toners of four colors (black, yellow, cyan, and magenta), respectively, and supply the toner to the electrostatic latent image on the surface of the photosensitive belt 22, thereby forming a toner image. The image forming section 3 further includes a discharger 15, a first cleaner 20, a second cleaner 23, and a cleaning device 100. The paper feed section 11 has a paper feed cassette 6 that holds paper 27, such as cut paper, a paper feed roller 10, and a pair of registration rollers 12. The paper discharge section 24 has a discharge roller 18 and a discharge tray 28.

A printing operation of the full-color printer 1 will be described. A printing operation is started by reception of a print start signal from the host device (not shown). When a printing operation is started, the photosensitive belt 22 rotates in the direction P, and the surface of the photosensitive belt 22 is charged to a predetermined electric potential by the charging brush 8. Unevenness of charging of the surface of the photosensitive belt 22 is eliminated by the electrically-conductive roller 9. As a result, the surface of the photosensitive belt 22 is uniformly charged. Then, the exposure device 5 emits the laser beam 7 to the surface of the photosensitive belt 22, thereby forming an electrostatic latent image thereon. The electrostatic latent image is developed as a toner image by one of the developing devices 31 through 34, and then the toner image is transferred to the intermediate transfer body 21. At this time, toner and/or silica may remain on the surface of the photosensitive belt 22 without being transferred to the intermediate transfer body 21, but such toner and/or silica is removed by the second cleaner 23. The photosensitive belt 22 is then charged by the charging brush 8 and the electrically-conductive roller 9 again.

By repeating the above-described process three or four times with using different one of the developing devices 31 through 34, a color toner image is formed on the intermediate transfer body 21 by toners of a plurality of colors. Meantime, the paper feed roller 10 picks up paper 27 from the paper feed cassette 6 one sheet at a time, and transports the paper 27 to the registration rollers 12. The registration rollers 12 supply the paper 27 to the transfer roller 13 at predetermined timing so that the position of the color toner image transferred onto the intermediate transfer body 21 and the position for transfer to the paper 27 coincide. Then, the color toner image is transferred from the intermediate transfer body 21 onto the paper 27 by the transfer roller 13. Then, the paper 27 is separated from the intermediate transfer body 21 by the separating member 15, and is transported toward the fixing device 19. At this point, an unfixed color toner image is attached to the paper 27. The fixing device 19 fixes the unfixed color toner image to the paper 27. Then, the paper discharge roller 18 discharges the paper 27 onto the discharge tray 28. The first cleaner 20 removes, from the surface of the intermediate transfer body 21, toner and/or silica that was not transferred to the paper 27 at the time of transfer.

However, toner and/or silica attaching to the photosensitive belt 22 cannot be completely removed by the second cleaner 23, and such toner and/or silica attaches to the electrically-conductive roller 9. Thus, in the present embodiment, toner and/or silica attaching to the electrically-conductive roller 9 is removed by the cleaning device 100.

The cleaning device 100 and its peripheral parts will be described in detail with reference to FIG. 2. Side plates 101, arm members 102, and springs 103 (only one of each is shown in FIG. 2) are disposed at respective ends of the charging brush 8 and the electrically-conductive roller 9. The side plates 101 are fixed to the main casing 2. A core of the charging brush 8 is rotatably supported by the side plates 101. A gear (not shown) is fixed to one end of the core of the charging brush 8 and rotated by a drive source (not shown) so as to rotate the charging brush 8. A core of the electrically-conductive roller 9 is rotatably supported on the arm members 102. The arm members 102 have a shaft (not shown), and are supported by the side plates 101 so as to be rotatable about the shaft. Each spring 103 is located between the corresponding side plate 101 and arm member 102, and urges the arm member 102 toward the photosensitive belt 22. Thus, the electrically-conductive roller 9 contacts the surface of the photosensitive belt 22 with appropriate pressure, and rotates following the rotation of the photosensitive belt 22.

The cleaning device 100 includes a pair of velvet flocked sheets 104, a pair of polyethylene terephtalate (PET) sheets 105, and a metal holder 106. The metal holder 106 has a V-shape in cross-section formed by two arm sections 106A, and each lengthwise end of the metal holder 106 is fixed to the corresponding side plate 101 below the electrically-conductive roller 9. The PET sheets 105 are attached to mutually opposed surfaces of respective arm sections 106A, and a side section of each PET sheet 105 extends toward the electrically-conductive roller 9 beyond the arm section 106A. The flocked sheets 104 are attached to the surfaces of respective PET sheets 105 opposite the electrically-conductive roller 9. That is, each flocked sheet 104 is supported independently by the metal holder 106 via the PET sheet 105. The elasticity of the PET sheets 105 uniformly urges the flocked sheets 104 to contact the surface of the electrically-conductive roller 9 with appropriate force so that the electrically-conductive roller 9 is nipped between the flocked sheets 104. By this means, toner and/or silica attaching to the electrically-conductive roller 9 is scraped by the flocked sheets 104 as the electrically-conductive roller 9 rotates and trapped among the fibers of the flocked sheets 104. In the present embodiment, the total nip width between the flocked sheets 104 and the electrically-conductive roller 9 with respect to the rotation direction of the electrically-conductive roller 9 is approximately 4 mm. Note that as described later, if the total nip width is approximately 4 mm or greater, an adequate cleaning effect can be obtained.

Since toner and/or silica removed from the electrically-conductive roller 9 is trapped among the fibers of the flocked sheets 104, the cleaning capability of the cleaning device 100 can be maintained over a long period of time. As a result, the life of the electrically-conductive roller 9 can be extended. Moreover, because the flocked sheets 104 are made of velvet, a large amount of toner and/or silica can be trapped among the fibers. Therefore, the cleaning capability of the cleaning device 100 can be maintained over a longer period of time, and thus the life of the electrically-conductive roller 9 can be further extended. Also, because two flocked sheets 104 are provided to contact with the electrically-conductive roller 9 at two places in the present embodiment, the cleaning device 100 can be installed in a small space while securing a sufficient total nip width which cannot be secured in a case where a single flocked sheet 104 is provided to contact with the electrically-conductive roller 9 at one place.

The inventors have conducted an experiment to see the relationship between the cleaning effect of the cleaning device 100 and the total nip width between the flocked sheets 104 and the electrically-conductive roller 9. Table 1 shows the results of this experiment. The experiment was conducted under experimental conditions of 10° C. temperature and 20% humidity using the full-color printer 1 with the above-described configuration. A diameter of the electrically-conductive roller 9 was 11 mm, and a rotation speed of the photosensitive belt 22 was 202 mm/sec.

TABLE 1

| TOTAL NIP WIDTH BETWEEN FLOCKED SHEETS AND ELECTRICALLY-CONDUCTIVE ROLLER AT TWO PLACES [mm] | CLEANING EFFECT |
|---|---|
| 2 | X |
| 3 | Δ |
| 4 | ○ |

The left-hand column in Table 1 shows total nip width between the flocked sheets 104 and the electrically-conductive roller 9 at two places, and the right-hand column shows the cleaning effect. Note that "x" in Table 1 indicates the occurrence of striped filming extending along the rotation direction of the electrically-conductive roller 9 over the entire width of the electrically-conductive roller 9, and that "Δ" indicates the occurrence of a few filming stripes extending along the rotation direction of the electrically-conductive roller 9 over the entire width of the electrically-conductive roller 9. "○" indicates no occurrence of filming on the surface of the electrically-conductive roller 9.

As will be understood from Table 1, a larger nip width between the flocked sheets 104 and the electrically-conductive roller 9 is preferable. One possible explanation for this is that a larger nip width means that the contact area between the flocked sheets 104 and the electrically-conductive roller 9 is larger, enabling the flocked sheets 104 to hold a greater amount of toner and/or silica.

An image forming apparatus according to the present invention is not limited to the above-described embodiment, and it would be apparent to those skilled in the art that various changes and modifications may be made therein without departing from the spirit of the invention, the scope of which is defined by the attached claims. For example, the image forming apparatus is not limited to the full-color printer 1, but could be a single-color printer. Also, in the above embodiment, the photosensitive belt 22 is used as the photosensitive body, but the photosensitive body could be a photosensitive drum.

What is claimed is:

1. An image forming apparatus comprising:

a photosensitive body that is rotatable in a predetermined direction;

a first charger that contacts the photosensitive body and charges a surface of the photosensitive body;

a second charger that contacts the photosensitive body at a position downstream from the first charger in the predetermined direction, the second charger eliminating unevenness of charging of the photosensitive body charged by the first charger, thereby making an electrical potential of the photosensitive body uniform; and a cleaning device that cleans a surface of the second charger, wherein:

the cleaning device has a pair of flocked sheets, each flocked sheet being in surface contact with the second charger.

2. The image forming apparatus according to claim 1, wherein the pair of flocked sheets comprise velvet flocked sheets.

3. The image forming apparatus according to claim 2, wherein the cleaning device further has a supporting member that supports each flocked sheet independently.

4. The image forming apparatus according to claim 1, wherein the cleaning device further has a supporting member that supports each flocked sheet independently.

5. The image forming apparatus according to claim 4, wherein the supporting member has a V-shape in cross-section formed by two arm sections, and the cleaning device further has a plurality of elastic sheets attached to mutually opposed surfaces of respective arm sections, and the flocked sheet members are attached to the surfaces of the respective elastic sheets.

6. The image forming apparatus according to claim 1, further comprising:

an exposure device that forms an electrostatic latent image on the surface of the photosensitive body; and a developing device that accommodates toner and supplies the toner to the electrostatic latent image on the surface of the photosensitive body.

7. The image forming apparatus according to claim 1, wherein the second charger comprises a roller.

8. An image forming apparatus comprising:

a photosensitive body that is rotatable in a predetermined direction;

a first charger that contacts the photosensitive body and charges a surface of the photosensitive body;

a second charger that contacts the photosensitive body at a position downstream from the first charger in the predetermined direction, the second charger eliminating unevenness of charging of the photosensitive body charged by the first charger, making an electrical potential of the photosensitive body uniform; and a cleaning device that cleans a surface of the second charger, wherein the cleaning device has a pair of flocked sheets, each flocked sheet being in surface contact with the second charger and at least one of the flocked sheets being substantially coextensive with the second charger.

9. The image forming apparatus according to claim 8, wherein the at least one flocked sheet is a plurality of flocked sheets.

10. The image forming apparatus according to claim 8, wherein the at least one flock sheet includes fibers and the at least one flocked sheet is stationary with respect to the second charger, except for the fibers.

11. The image forming apparatus according to claim 8, wherein the second charger comprises a roller.

12. The image forming apparatus of claim 8, wherein each flocked sheet has a supporting member that supports each flocked sheet independently.

13. The image forming apparatus according to claim 12, wherein the supporting member has a V-shape cross-section formed by two arm sections, and a plurality of elastic sheets are attached to mutually opposed surfaces of the respective arm sections, and the flocked sheets are attached to the surfaces of the respective elastic sheets.

14. The image forming apparatus of claim 8, wherein the flocked sheets comprise a plurality of flocked sheet members, and the cleaning device further has a supporting member that supports each flocked sheet member independently.

15. The image forming apparatus according to claim 14, wherein the supporting member has a V-shape cross-section formed by two arm sections, and the cleaning device further has a plurality of elastic sheets attached to mutually opposed surfaces of respective arm sections, and the flocked sheet members are attached to the surfaces of the respective elastic sheets.

16. An image forming apparatus comprising:

a photosensitive body that is rotatable in a predetermined direction;

a first charger that contacts the photosensitive body and charges a surface of the photosensitive body;

a second charger that contacts the photosensitive body at a position downstream from the first charger in the predetermined direction, the second charger eliminating unevenness of charging of the photosensitive body charged by the first charger, thereby making an electrical potential of the photosensitive body uniform; and a cleaning device that cleans a surface of the second charger, wherein the cleaning device has a pair of flocked sheets, each flocked sheet being in surface contact with the second charger and at least one of the flocked sheets has a length substantially the same as the second charger.

* * * * *